US012601153B2

(12) United States Patent
Feuerhelm et al.

(10) Patent No.: US 12,601,153 B2
(45) Date of Patent: Apr. 14, 2026

(54) GUIDE LINK ARM ASSEMBLY AND METHOD FOR A WORK MACHINE

(71) Applicant: Deere & Company, Moline, IL (US)

(72) Inventors: Jeffrey L. Feuerhelm, Dubuque, IA (US); John S. Foltz, Dubuque, IA (US); Vinod Kumar Velayudhan, Pune (IN); Vikas Patil, Pune (IN); Anjul Sharma, Pune (IN); Swapnil Ghodake, Pune (IN); Richard Pugh, Dubuque, IA (US); Thomas R. Vantiger, Peosta, IA (US)

(73) Assignee: Deere & Company, Moline, IL (US)

( * ) Notice: Subject to any disclaimer, the term of this patent is extended or adjusted under 35 U.S.C. 154(b) by 433 days.

(21) Appl. No.: 18/341,938

(22) Filed: Jun. 27, 2023

(65) Prior Publication Data

US 2025/0003195 A1 Jan. 2, 2025

(51) Int. Cl.

| | |
|---|---|
| ***E02F 9/26*** | (2006.01) |
| ***E02F 3/32*** | (2006.01) |
| ***E02F 3/36*** | (2006.01) |

(52) U.S. Cl.

CPC ..... *E02F 9/26* (2013.01); *E02F 3/32* (2013.01); *E02F 3/36* (2013.01)

(58) Field of Classification Search

CPC ..... E02F 9/26; E02F 9/264; E02F 3/32; E02F 3/36; G01B 5/24; B25J 13/088

See application file for complete search history.

(56) References Cited

U.S. PATENT DOCUMENTS

| | | | | |
|---|---|---|---|---|
| 10,378,180 | B2 * | 8/2019 | Hosaka | E02F 3/965 |
| 11,649,613 | B2 * | 5/2023 | Boss | G01S 19/47 701/32.4 |
| 11,708,683 | B2 * | 7/2023 | Boss | G01S 19/14 701/50 |
| 2022/0170239 | A1 * | 6/2022 | Kean | E02F 9/265 |

(Continued)

FOREIGN PATENT DOCUMENTS

| | | | |
|---|---|---|---|
| EP | 3530819 A1 | 8/2019 | |
| EP | 4603642 A1 * | 8/2025 | E02F 9/265 |

(Continued)

OTHER PUBLICATIONS

Yutong Lin et al., Research on the Prediction Method of Braking Rotation Angle for Remote-Controlled Excavator, Jul. 28, 2023, pp. 1-27, [online]. Retrieved from the Internet <URL: https://www.google.com/search?q=Excavator+bucket+angle+detection+device+for+improving+signal+transmission+reliability&rlz=1C1GCEA_enIN983IN983&ei=3hKaYoUZ6s_aug-tta-QCg&start=0&sa=N&ved=2ahUKEwiFgJDTt5H4AhXqp1YBHa3aC614ChDy0wN6BAgBEDc&biw=1536&bih=664&dpr=1.25>.

*Primary Examiner* — Jacob J Cigna

(57) ABSTRACT

A guide link arm assembly for coupling a sensor to a boom of a work machine is disclosed. The guide link arm assembly comprises a single-piece elongated member with a first pivotal coupling on a first end and a second pivotal coupling on a second end. The elongated member includes a sensor housing recess defined in part by a base surface and opposed sensor housing recess surfaces extending from the base surface. The sensor housing recess configured to receive the sensor, and further includes a first boss and a second boss extending from the base surface. A restricting member removably coupled to a boss surface of the first boss and the second boss secures the sensor when coupled to the boss (Continued)

surface. A cover is removably coupled to the elongated member for enclosing the sensor.

20 Claims, 8 Drawing Sheets

(56) References Cited

U.S. PATENT DOCUMENTS

| | | | | |
|---|---|---|---|---|
| 2022/0364334 | A1* | 11/2022 | Nicholls | E02F 9/264 |
| 2025/0003195 | A1* | 1/2025 | Feuerhelm | E02F 3/32 |

FOREIGN PATENT DOCUMENTS

| | | | | |
|---|---|---|---|---|
| JP | H0564717 | U | * | 8/1993 |
| JP | H0614258 | U | * | 2/1994 |
| JP | 2004279047 | A | * | 10/2004 |
| JP | 2017083184 | A | * | 5/2017 |
| JP | 6172172 | B2 | * | 8/2017 |
| JP | 2019203244 | A | * | 11/2019 |

* cited by examiner

610

GUIDE LINK ARM ASSEMBLY AND METHOD FOR A WORK MACHINE

TECHNICAL FIELD

The present disclosure relates generally to a guide link arm assembly and method for a work machine, and more specifically to a guide link arm assembly with an integrated sensor.

BACKGROUND

With the onset of smart technologies and automation, sensors may be placed in atypical areas of a work machine, such as the boom-arm assembly. Advanced technologies such as grade control, payload weighing, virtual fencing, machine tracking, frequently rely on one or more of these sensors to provide feedback. Current approaches utilize bulky sensor housings welded or bolted onto a respective exterior portion of the boom, arm, or bucket linkage assembly. This configuration proposes challenges in precision placement on the machine, added shearing force exposure from debris, an unsightly appearance, and difficulty retrofitting older pieces of equipment. Because of the longevity of a work machine's useful life, therein lies a need to adapt a boom-arm assemblies with sensors economically and efficiently, for new and older work machines, without comprising strength while optimizing the configuration for precision and function.

SUMMARY

A work machine with guide link arm assembly for sensor integration is disclosed. The work machine comprises a frame, a ground-engaging mechanism supporting the frame, and multiple components of a boom-arm assembly. The boom-arm assembly includes a boom pivotally coupled to the frame: a first actuator interconnecting the boom and the frame: a dipper stick pivotally: a second actuator interconnecting the dipper stick and the boom: an implement; and a third actuator interconnecting the implement and the dipper stick. The second actuator is operable to move the dipper stick relative about the pivot axis relative to the boom. The third actuator is operable to move the implement relative to the dipper stick. The work machine further comprises a sensor operable to sense one or more of the implement position and the direction of movement of one or more of the boom, the dipper stick, and the implement. A guide link arm assembly is pivotally coupled to the dipper stick on a first end and pivotally coupled to the implement on a second end. The guide link arm assembly comprises an elongated member having a sensor housing recess defined in part by a base surface and opposed sensor housing recess surfaces extending from the base surface. The sensor housing recess is configured to receive the sensor. The guide link arm assembly further comprises a lip along a portion of the recess wherein the lip supports the cover. The perimeter of the outer surface of the cover of the guide link arm assembly sits at or below an outward facing surface of the elongated member proximal to the cover when coupled to the elongated member. A fastener securing the cover of the guide link arm assembly sits at or below the outermost surface of the elongated member.

The opposed sensor housing recess surfaces of the guide link arm assembly comprises an aperture configured to receive a sensor wiring harness extending from the sensor. The aperture comprises of a first aperture wall, a second aperture wall, and a third aperture wall, wherein the cover provides a fourth aperture wall when coupled to the elongated member. The sensor housing recess is proximal to the pivotal coupling positioned distal from the implement.

The guide link arm assembly further comprises an adapter connected to an outward facing surface of the elongated arm wherein the adapter is configured to couple a wiring harness hose to the elongated member.

The elongated member of the guide link arm assembly further comprises of a boss extending from the base surface within the sensor housing recess wherein the boss is configured to support the sensor. A restricting member is removably coupled to a boss surface of the boss wherein the restricting member secures the sensor when fixedly coupled to the boss surface. The guide link arm assembly may further comprise a guide link arm protrusion extending from an outward facing surface of the elongated member wherein the guide link arm protrusion is configured to engage a resting surface when second actuator and the third actuator are substantially extended, resulting in curling of the boom-arm assembly 120 towards the frame.

A method of producing a guide link arm assembly comprises the following steps. First, the method includes providing a single-piece elongated member with a first pivotal coupling on a first end, and a second pivotal coupling on a second end. The elongated member includes a sensor housing recess defined in part by a base surface and opposed sensor housing recess surfaces extending from the base surface. The sensor housing recess is configured to receive the sensor. The method then includes providing a restricting member removably coupled to the base surface, wherein the restricting member secures the sensor when coupled to the base surface. In a next step, the method includes providing a cover removably coupled to the elongated member for enclosing the sensor in the sensor housing recess. The method then includes securing the cover to the elongated member at a first contact area and a second contact area using fasteners.

The above features and advantages and other features and advantages of the present teachings are readily apparent from the following detailed description of the best modes for carrying out the teachings when taken in connection with the accompanying drawings.

DETAILED DESCRIPTION

Figure 1:
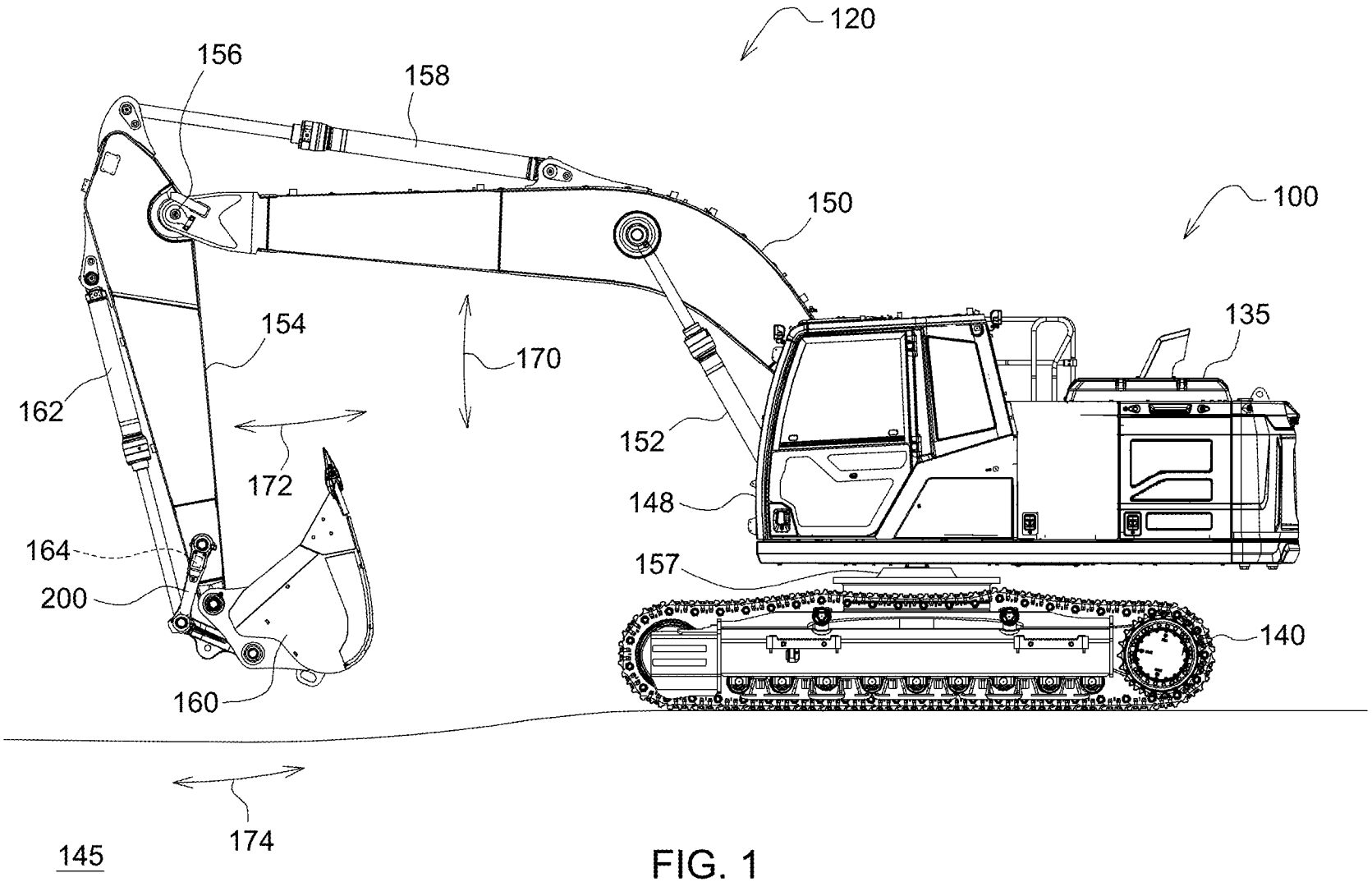
FIG. 1 is a side view of a work machine, shown as an excavator, according to one aspect of the present disclosure.
Figure 2A:
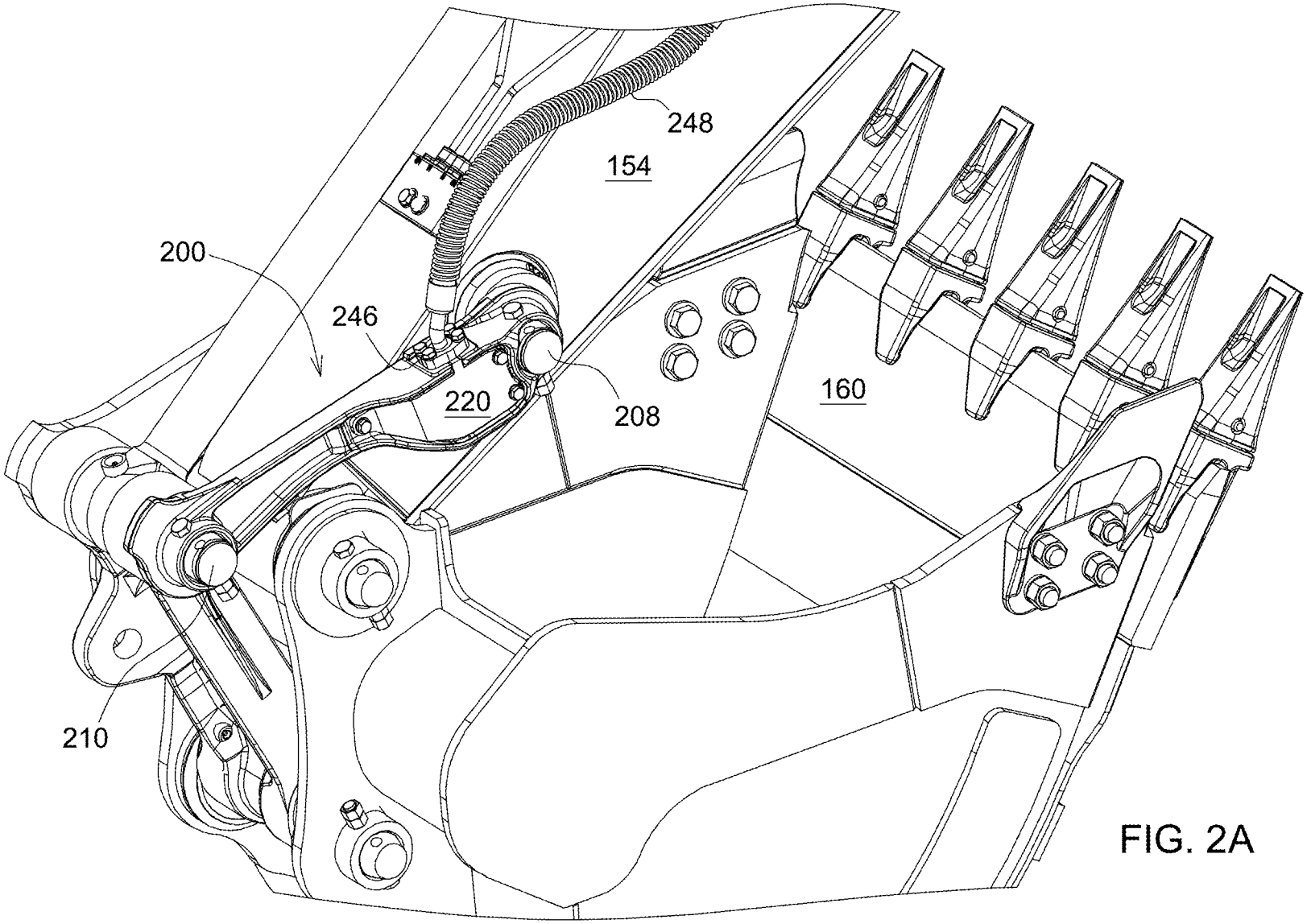
FIG. 2A is an enlarged perspective view of a portion of the boom-arm assembly including the guide link arm and implement of the work machine of FIG. 1.
Figure 2B:
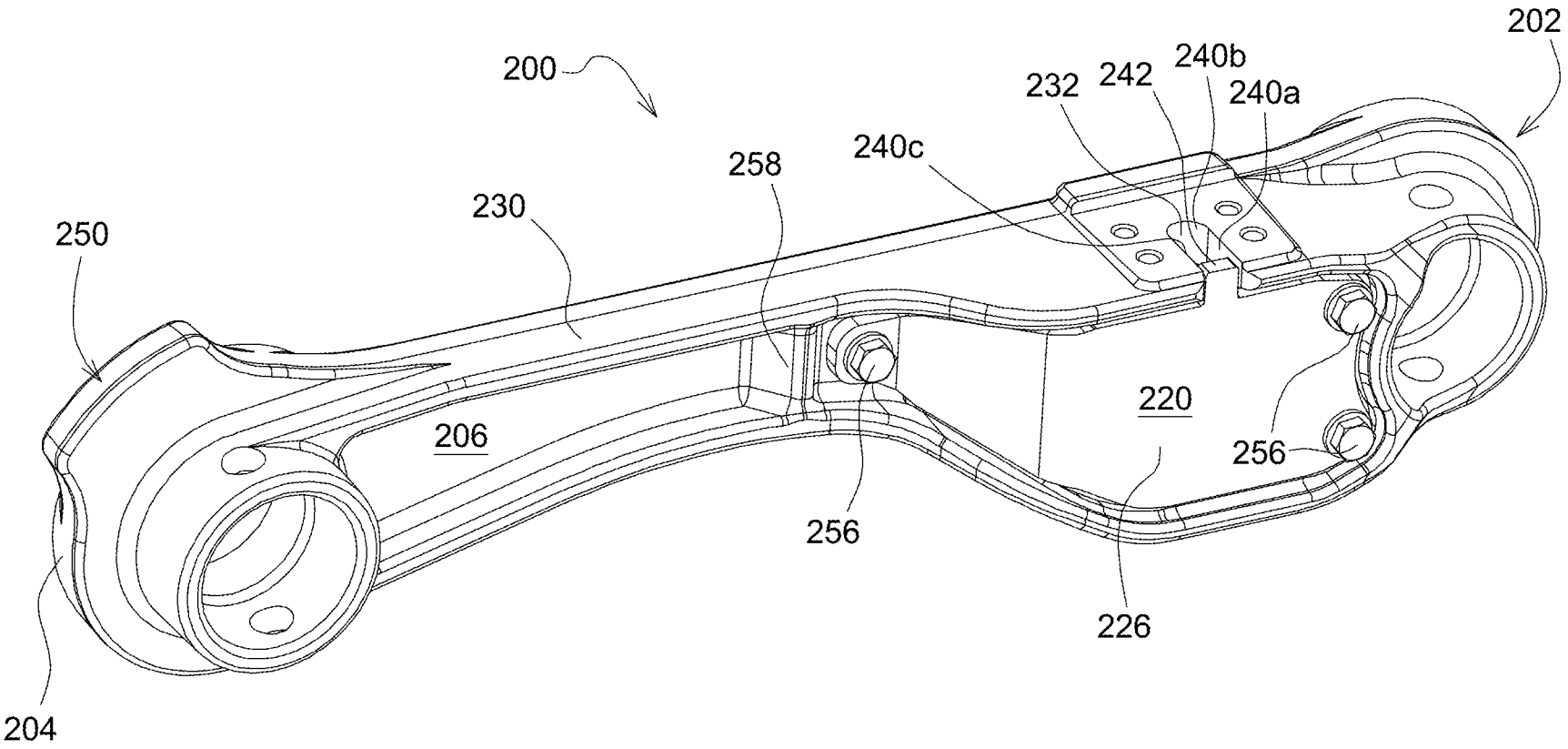
FIG. 2B is a perspective side view of the guide link arm assembly from FIG. 2A.
Figure 3:
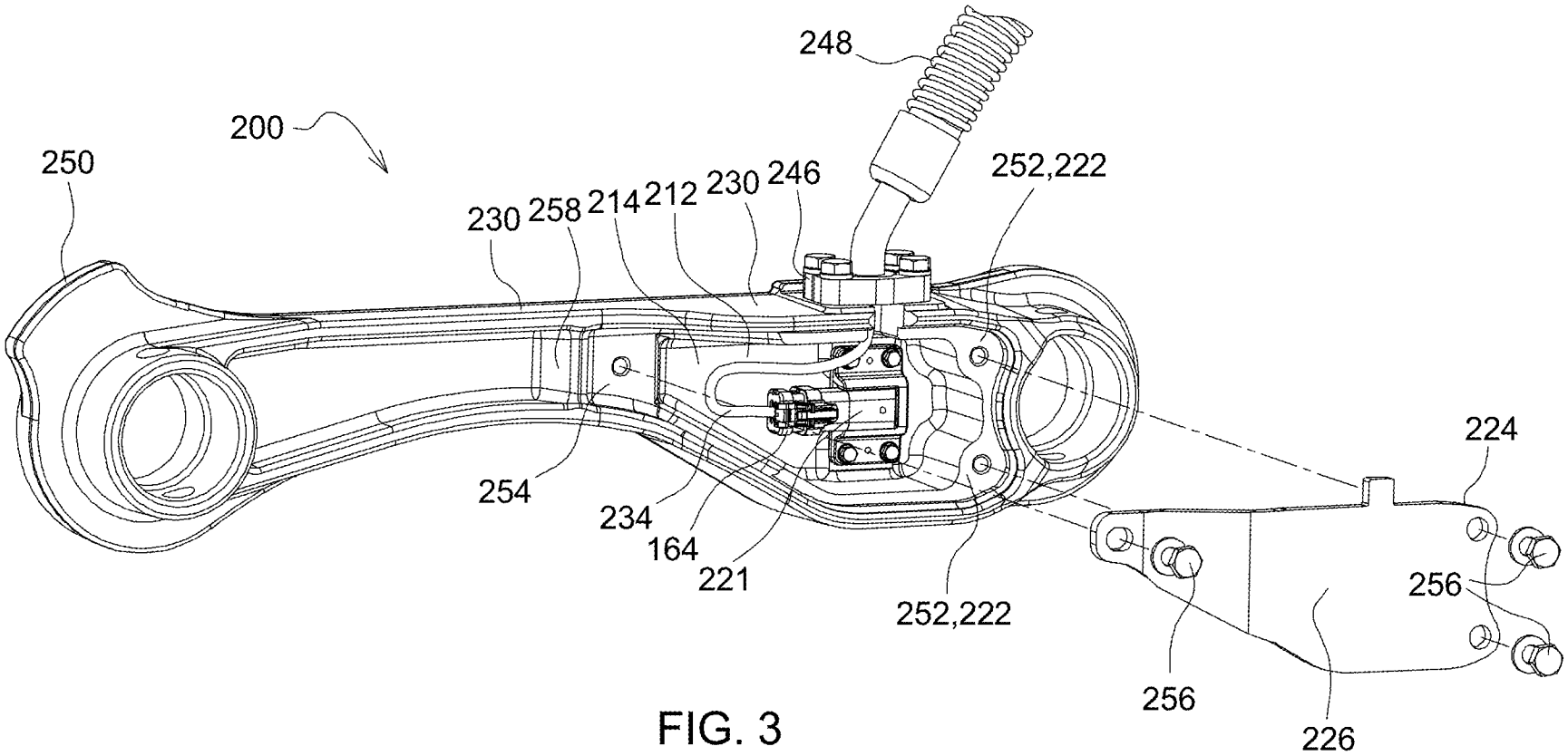
FIG. 3 is a perspective side view of the guide link arm assembly with an exploded view of the cover and fasteners.
Figure 4:
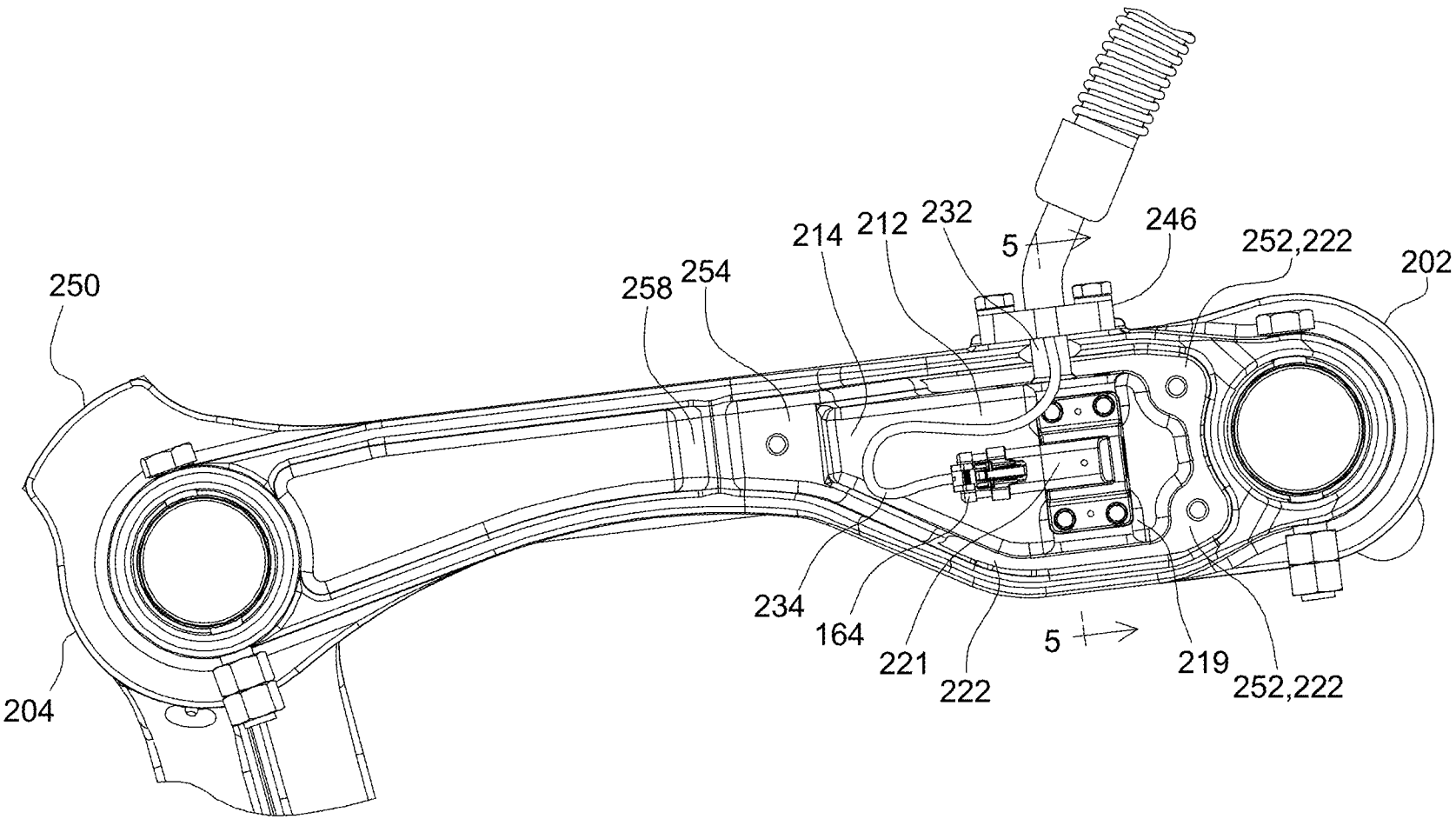
FIG. 4 is a side view of the guide link arm assembly with the cover and fasteners removed.
Figure 5:
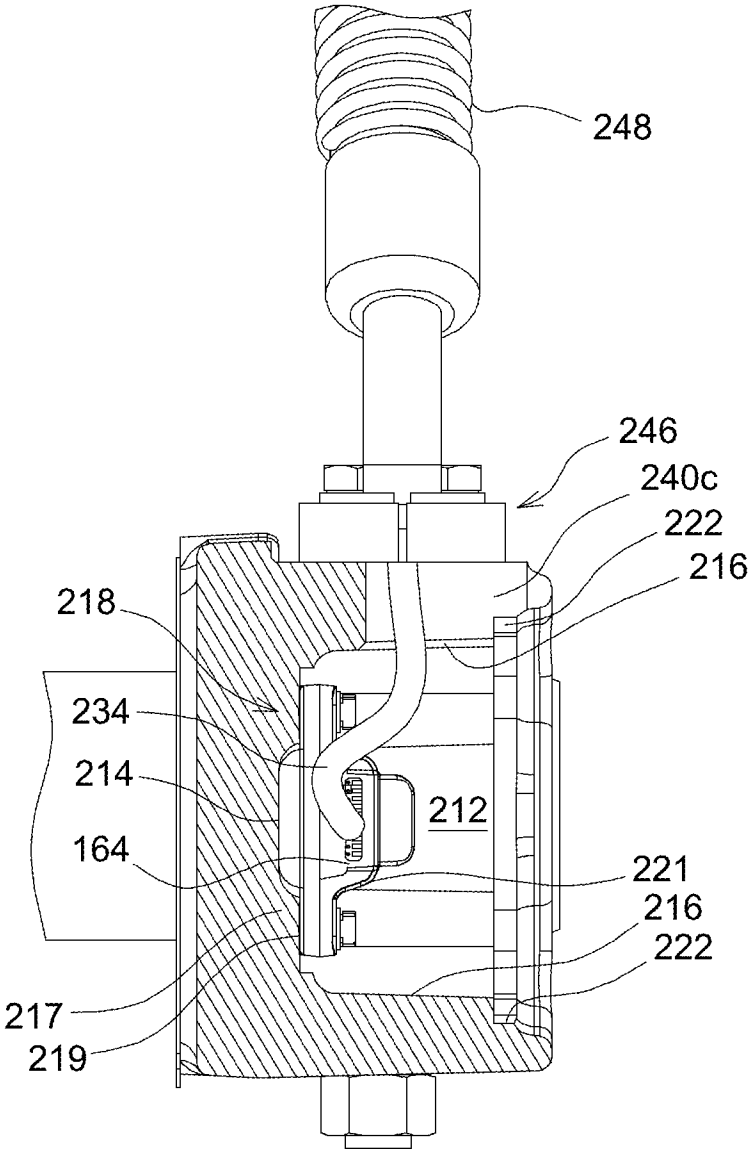
FIG. 5 is a cross-sectional view of the guide link arm in FIG. 4 taken along line 5-5 of FIG. 4, according to one aspect of the present disclosure.

Referring now to the drawings and with specific reference to FIG. 1, a perspective view of an exemplary work machine 100 is shown and referred to by reference numeral 100. The illustrated work machine is an excavator, but the present disclosure may also apply to other types of work machines which utilize a guide link arm assembly 200 having a sensor 164 coupled thereto wherein the sensor is typically used as a feedback mechanism for control of the work machine 100. These include backhoes, loaders, skid steers, skidders, knuckle boom loaders, and forwarders, to name a few. Such work machines are used in a variety of industries such as construction, forestry, mining, and the like.

The work machine 100 comprises of a frame 135, a ground-engaging mechanism 140 configured to support the frame 135 on a ground surface 145. For the present exemplary embodiment shown as an excavator, the upper portion of the frame 135 is pivotally mounted on an undercarriage with a ground-engaging mechanism 140 by means of a swing pivot 157. The ground-engaging mechanism 140 may comprise of a pair of tracks or wheels for moving along the ground surface 145. The frame 135 may include an operator cab 148 (although not required in cab-less machines operated remotely) with a boom-arm assembly 120 coupled thereto. The boom-arm assembly 120 comprises of a boom 150 pivotally coupled to the frame 135. A first actuator 152 interconnects the boom 150 and the frame 135. The first actuator 152 is operable to move the boom 150 relative to the frame 135. A dipper stick 154 may be pivotally coupled to the boom 150 for rotational movement about a pivot axis 156. A second actuator 158 interconnects the dipper stick 154 and the boom 150. The second actuator 158 is operable to move the dipper stick 154 about the pivot axis 156 relative to the boom 150. An implement 160, shown here as a bucket, is pivotally coupled to the dipper stick 154. A third actuator 162 interconnects the implement 160 and the dipper stick 154 wherein the third actuator 162 is operable to move the implement 160 relative to the dipper stick 154. One or more sensors may sense one of a position and a direction of movement of either the boom 150, the dipper stick 154 and the implement 160. The arrows 170, 172, and 174 identify movement direction of each of the boom, the dipper stick, and the implement, respectively. However, coupling a sensor 164 to the guide link arm assembly 200 provides an absolute measure of movement so as to fine tune movement of the boom-arm assembly 120 through feedback to a controller (not shown). The guide link arm assembly 200 of the disclosed embodiment advantageously improves mounting integrity and orientation of the sensor 164, such as an IMU. An IMU is an electronic device that measures and reports a body's specific force, angular rate, and/or the orientation of the body, using a combination of accelerometers, gyroscopes, and/or magnetometers. In some embodiments, an IMU works by detecting linear acceleration using one or more accelerometers and rotational rate using one or more gyroscopes. Linear acceleration may be defined along a longitudinal, lateral, and vertical axis (x, y, and z). Rotation rate may be defined along the same three axes and is referred to as roll, pitch and yaw. In one exemplary operation of the work machine operation, sensing movement of the boom-arm assembly 120 using sensor 164 optimizes digging a trench for pipe-laying where uniformity and grade of the ground surface in the trench is critical for proper pipe-laying. Other exemplary work machine operations may require a surface of the implement 160 to maintain contact with the ground surface 145 to achieve the target grade. Furthermore, a periodic calibration of a signal communicated from a sensor 164 coupled to the boom-arm assembly 120 improves precision control by allowing for confirmation and correction of a target position versus the actual position.

Now turning to FIGS. 2A-5, the guide link arm assembly 200 is pivotally coupled to the dipper stick 154 on a first end 202 and pivotally coupled to the implement 160 on a second end 204. The guide link arm assembly 200 provides guidance and support for movement about the implement 160 and dipper stick 154 coupling. The guide link arm assembly 200 comprises of a single-piece elongated member 206 with a first pivotal coupling 208 on the first end 202 and a second pivotal coupling 210 on the second end 204. Although the guide link arm assembly is shown and described as coupled to one side of the boom-arm assembly 120 (i.e. to the left of an operator), a mirrored configuration of the guide link arm assembly 200 would function the same if coupled to the opposite side of the boom-arm assembly 120 (i.e. to the right of the boom-arm assembly 120). The elongated member 206 includes a sensor housing recess 212 defined at least in part by a base surface 214 and opposed sensor housing recess surfaces 216 extending from the base surface 214. The sensor housing recess 212 is configured to receive the sensor 164. The elongated member 206 further includes a first boss 218 and a second boss 217 extending from the base surface 214 wherein the first boss 218 and the second boss 217 are configured to support the sensor 164. It may be contemplated that the first boss 218 and the second boss 217 may be configured to secure the sensor 164 to the base surface 214 of the recess 212 if configured for a press fit with the senor 164. However, in the present embodiment, a restricting member 221 is removably coupled to a boss surface 219 of the first boss 218 and the second boss 217 wherein the restricting member 221 secures the sensor 164 when fixedly coupled to the boss surface 219. A cover 220 is removably coupled to the elongated member 206 for enclosing the sensor 164 in the sensor housing recess 212. Although it may be contemplated to adapt another boom-arm assembly 120 component with the same features to integrate and house a sensor 164, integration with the guide link arm assembly 200 advantageously enables case of retrofitting older work machines because of accessibility and size. Furthermore, the unique placement of the sensor 164 within the sensor housing recess 212, which is described in further detail below, secures the sensor 164 from movement and protects the sensor 164 from encountering shearing forces encountered by debris during a digging operation. Additionally, sensor placement in the guide link arm assembly 200 provides precision positioning feedback of the implement 160 while minimizing the introduction of vibratory noise from operations.

The elongated member 206 may further comprise a lip 222 along at least a portion of the sensor housing recess 212 wherein the lip 222 is configured to support the cover 220. The perimeter 224 of the outer surface 226 of the cover 220 preferably sits at or below the outward facing surface 230 of the elongated member 206. The outward facing surface 230 of the elongated member 206 is the surface facing the cover 220 where the cover couples to the elongated member 206. The cover 220 is secured to the elongated member 206 with fasteners 256. A ridge 258 or slope located near the hollowed surface of the elongated member 206, adjacent to the cover 220, advantageously provides a protective feature to reduce shearing forces encountered by the fasteners 256 from debris during operation. Fasteners 256 secure the cover 220 in position with a first contact area 252 and a second contact area 254.

One of the opposed sensor housing recess surfaces 216 further comprises of an aperture 232 configured to receive a sensor wiring harness 234 extending from the sensor 164. The aperture 232 is on an outward facing surface 230 (i.e. a surface facing substantially away from the ground surface 145 or a top surface of the guide link arm assembly 200). Placement of the aperture 232 closer to the first end 202 of the elongated member 206 advantageously reduces the area the sensor wiring harness 234 must extend over and allows the sensor wiring harness 234 to clear the path of movement of the implement 160. The aperture 232 comprises of a first aperture wall 240*a*, a second aperture wall 240*b*, and a third aperture wall 240*c*, wherein the cover 220 provides the fourth aperture wall 242 when connected to the elongated member 206. The sensor housing recess 212 is biased towards the first pivotal coupling 208. The guide link arm assembly 200 further comprises an adapter 246 connected to an outward facing surface of the elongated member 206 wherein the adapter 246 is configured to surround the sensor wiring harness 234 and couple a wiring harness hose 248 to the elongated member 206.

Figure 6:
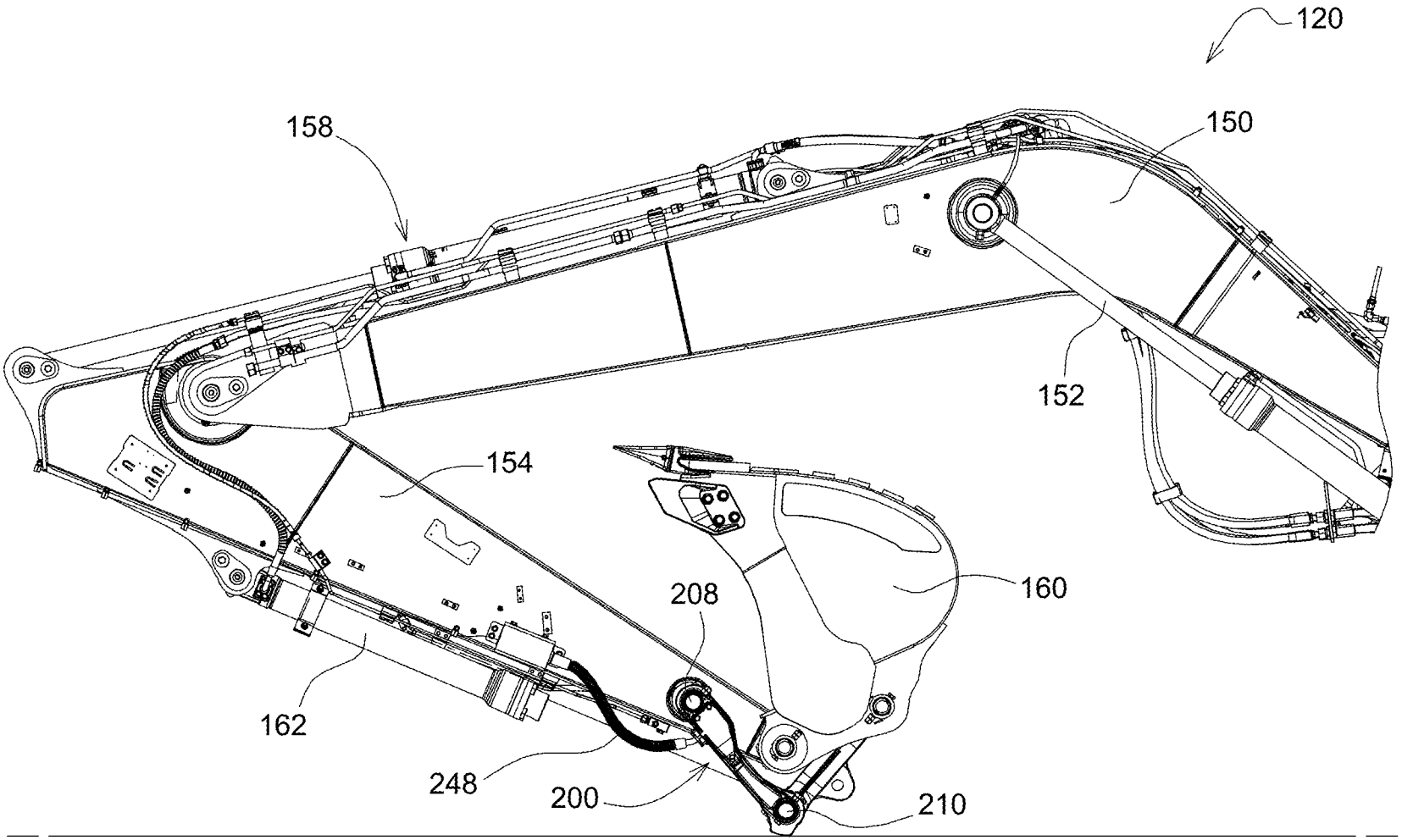
FIG. 6 is a side view of the guide link arm assembly in a curled position with a guide link arm protrusion engaging a resting surface.

The guide link arm assembly 200 may further comprise a guide link arm protrusion 250 extending from an outward facing surface 230 of the elongated member 206 and proximal to the first end 202, wherein the guide link arm protrusion 250 is configured to engage a resting surface when the second actuator 158, and the third actuator 162 are substantially extended, curling the boom-arm assembly 120 towards the frame 135 (as shown in FIG. 6). The resting surface 610 may comprise of a ground surface 145 or another surface when the work machine is not operating, e.g. a platform bed for transport. The guide link arm protrusion 250 advantageously enables the boom-arm assembly 120 to rest securely on a surface during shipping of the work machine 100. The combination of the guide link arm protrusion 250 and the sensor housing recess 212 with cover 220 provides a streamlined function, manufacturing, and appearance thereof.

Figure 7:
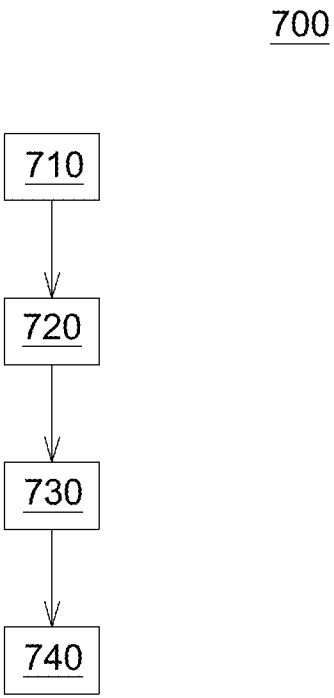
FIG. 7 is a flowchart for a method of producing a guide link with an integrated sensor, according to one aspect of the present disclosure.

FIG. 7 discloses a method 700 of producing a guide link arm assembly 200 comprises the following steps. In step 710, the method includes providing a single-piece elongated member 206 with a first pivotal coupling 208 on a first end 202, and a second pivotal coupling 210 on a second end 204. The elongated member 206 includes a sensor housing recess 212 defined in part by a base surface 214 and opposed sensor housing recess surfaces 216 extending from the base surface 214. The sensor housing recess 212 is configured to receive a sensor 164. The method then includes in step 720, providing a sensor 164 and a restricting member 221 removably coupled to the base surface 214, wherein the restricting member 221 secures the sensor 164 when coupled to the base surface 214. In a next step 730, the method includes providing a cover 220 removably coupled to the elongated member 206 for enclosing the sensor 164 in the sensor housing recess 212. The method in step 740 includes securing the cover 220 to the elongated member 206 at a first contact area 252 and a second contact area 254 using fasteners 256. In the exemplary embodiment, the fasteners 256 are bolts, but other removable fastener types are conceivable.

Those having ordinary skill in the art will recognize that terms such as "above," "below," "upward," "downward," "top." "bottom," etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may be comprised of any number of hardware, software, and/or firmware components configured to perform the specified functions.

Terms of degree, such as "generally", "substantially" or "approximately" are understood by those of ordinary skill to refer to reasonable ranges outside of a given value or orientation, for example, general tolerances or positional relationships associated with manufacturing, assembly, and use of the described embodiments.

As used herein, "e.g." is utilized to non-exhaustively list examples, and carries the same meaning as alternative illustrative phrases such as "including." "including, but not limited to," and "including without limitation." As used herein, unless otherwise limited or modified, lists with elements that are separated by conjunctive terms (e.g., "and") and that are also preceded by the phrase "one or more of," "at least one of." "at least," or a like phrase, indicate configurations or arrangements that potentially include individual elements of the list, or any combination thereof. For example, "at least one of A, B, and C" and "one or more of A, B, and C" each indicate the possibility of only A, only B, only C, or any combination of two or more of A, B, and C (A and B; A and C; B and C; or A, B, and C). As used herein, the singular forms "a", "an" and "the" are intended to include the plural forms as well, unless the context clearly indicates otherwise. Further, "comprises," "includes," and like phrases are intended to specify the presence of stated features, steps, operations, elements, and/or components, but do not preclude the presence or addition of one or more other features, steps, operations, elements, components, and/or groups thereof.

The invention claimed is:

1. A guide link arm assembly for coupling a sensor to a boom of a work machine, the guide link arm assembly comprising:

a single-piece elongated member with a first pivotal coupling on a first end and a second pivotal coupling on a second end, the elongated member including a sensor housing recess defined in part by a base surface and opposed sensor housing recess surfaces extending from the base surface, the sensor housing recess configured to receive the sensor, the elongated member further including a first boss and a second boss extending from the base surface, the first and second boss configured to support the sensor;

a restricting member removably coupled to a boss surface of the first boss and the second boss, the restricting member securing the sensor when coupled to the boss surface; and a cover removably coupled to the elongated member for enclosing the sensor in the sensor housing recess.

2. The guide link arm assembly of claim 1, wherein the sensor housing recess is proximal to the first pivotal coupling, wherein the first pivotal coupling positioned distal from an implement.

3. The guide link arm assembly of claim 1, wherein the elongated member further comprises a lip along a portion of the recess, the lip supporting the cover.

4. The guide link arm assembly of claim 3, wherein a perimeter of an outer surface of the cover sits at or below an outward facing surface of the elongated member proximal to the cover when coupled to the elongated member.

5. The guide link arm assembly of claim 1, wherein one of the opposed sensor housing recess surfaces comprises of an aperture configured to receive a sensor wiring harness extending from the sensor.

6. The guide link arm assembly of claim 5, wherein the aperture comprises of a first aperture wall, a second aperture wall, and a third aperture wall, wherein the cover provides a fourth aperture wall when connected to the elongated member.

7. The guide link arm assembly of claim 5 further comprises an adapter connected to an outward facing surface of the elongated member, wherein the adapter is configured to couple a wiring harness hose to the elongated member.

8. A work machine, comprising:

a frame;

a ground-engaging mechanism supporting the frame;

a boom pivotally coupled to the frame;

a first actuator interconnecting the boom and the frame, the first actuator operable to move the boom relative to the frame;

a dipper stick pivotally coupled to the boom for rotational movement about a pivot axis;

a second actuator interconnecting the dipper stick and the boom, the second actuator operable to move the dipper stick about the pivot axis relative to the boom;

an implement pivotally coupled to the dipper stick;

a third actuator interconnecting the implement and the dipper stick, the third actuator operable to move the implement relative to the dipper stick;

a sensor operable to sense one or more of an implement position and a direction of movement of one or more of the boom, the dipper stick, and the implement;

a guide link arm assembly pivotally coupled to the dipper stick on a first end and pivotally coupled to the implement on a second end, the guide link arm assembly comprising an elongated member having a sensor housing recess defined in part by a base surface and opposed sensor housing recess surfaces extending from the base surface, the sensor housing recess configured to receive the sensor; and a cover removably coupled to the elongated member for enclosing the sensor in the sensor housing recess.

9. The work machine of claim 8, wherein the elongated member of the guide link arm assembly further comprises a lip along a portion of the recess, the lip supporting the cover.

10. The work machine of claim 8, wherein a perimeter of an outer surface of the cover of the guide link arm assembly sits at or below an outermost surface of the elongated member proximal to the cover when coupled to the elongated member.

11. The work machine of claim 8, wherein a fastener securing the cover of the guide link arm assembly sits at or below the outermost surface of the elongated member.

12. The work machine of claim 8, wherein the sensor housing recess is biased towards the first pivotal coupling.

13. The work machine of claim 8, wherein the elongated member of the guide link arm assembly further comprises:

a boss extending from the base surface within the sensor housing recess, the boss configured to support the sensor; and a restricting member removably coupled to a boss surface of the boss, the restricting member securing the sensor when fixedly coupled to the boss surface.

14. The work machine of claim 8 further comprising a guide link arm protrusion extending from an outward facing surface of the elongated member wherein the guide link arm protrusion is configured to engage a resting surface when the second actuator, and the third actuator are substantially extended, curling the dipper stick towards the frame.

15. The work machine of claim 8, wherein one of the opposed sensor housing recess surfaces of the guide link arm assembly comprises an aperture configured to receive a sensor wiring harness extending from the sensor.

16. The work machine of claim 15, wherein the aperture comprises of a first aperture wall, a second aperture wall, and a third aperture wall, wherein the cover provides a fourth aperture wall when coupled to the elongated member.

17. The work machine of claim 15, wherein guide link arm assembly further comprises an adapter connected to an outward facing surface of the elongated arm wherein the adapter is configured to couple a wiring harness to the elongated member.

18. A method of producing a guide link arm assembly, the method comprising:

providing a single-piece elongated member with a first pivotal coupling on a first end and a second pivotal coupling on a second end, the elongated member having a sensor housing recess defined in part by a base surface and opposed sensor housing recess surfaces extending from the base surface and configured to receive a sensor;

providing a restricting member removably coupled to the base surface, the restricting member securing the sensor when coupled to the base surface;

providing a cover removably coupled to the elongated member for enclosing the sensor in the sensor housing recess;

securing the cover to the elongated member with at a first contact area and a second contact area.

19. The method of claim 18, wherein the elongated member further comprises a lip along a portion of the recess, the lip supporting the cover, the opposed sensor housing surfaces guiding positioning of the cover; and a perimeter of an outer surface of the cover sits at or below an outward facing surface of the elongated member proximal to the cover when coupled to the elongated member.

20. The method of claim 18, wherein one of the opposed sensor housing recess surfaces comprises of an aperture configured to receive a sensor wiring harness extending from the sensor, wherein the aperture comprises of a first aperture wall, a second aperture wall, a third aperture wall, and a fourth aperture wall provided by the cover when the cover is coupled to the elongated member.

* * * * *